US010786050B2

(12) United States Patent
Ichikawa et al.

(10) Patent No.: US 10,786,050 B2
(45) Date of Patent: Sep. 29, 2020

(54) FEMALE MEMBER OF SNAP FASTENER AND RESIN SPRING USED THEREIN

(71) Applicant: MORITO CO., LTD., Osaka-shi (JP)

(72) Inventors: Junya Ichikawa, Osaka (JP); Yoshio Sato, Osaka (JP); Yoshiki Nakatsuka, Osaka (JP)

(73) Assignee: MORITO CO., LTD., Osaka (JP)

( * ) Notice: Subject to any disclaimer, the term of this patent is extended or adjusted under 35 U.S.C. 154(b) by 0 days.

(21) Appl. No.: 16/098,635

(22) PCT Filed: Jun. 22, 2017

(86) PCT No.: PCT/JP2017/022990
§ 371 (c)(1),
(2) Date: Nov. 2, 2018

(87) PCT Pub. No.: WO2017/222008
PCT Pub. Date: Dec. 28, 2017

(65) Prior Publication Data

US 2019/0133263 A1 May 9, 2019

(30) Foreign Application Priority Data

Jun. 23, 2016 (JP) ..... 2016-124196

(51) Int. Cl.
*A44B 17/00* (2006.01)

(52) U.S. Cl.
CPC ..... *A44B 17/0076* (2013.01); *A44B 17/0011* (2013.01); *A44B 17/0023* (2013.01); *A44B 17/0047* (2013.01); *A44B 17/0029* (2013.01)

(58) Field of Classification Search
CPC ..... A44B 17/0076; A44B 17/0011; A44B 17/0047; A44B 17/0029; Y10T 24/45822; Y10T 24/45827
See application file for complete search history.

(56) References Cited

U.S. PATENT DOCUMENTS 2,829,416 A * 4/1958 Sam ..... A44B 17/0011 24/676
3,999,257 A * 12/1976 Ishizaki ..... A44B 17/0011 24/676
4,361,936 A * 12/1982 Kurashima ..... A44B 5/02 24/102 PL (Continued)

FOREIGN PATENT DOCUMENTS

DE 3821003 A1 12/1989
JP S60-103306 U 7/1985

(Continued)

*Primary Examiner* — Robert Sandy
*Assistant Examiner* — Michael S Lee
(74) *Attorney, Agent, or Firm* — Bacon & Thomas, PLLC

(57) ABSTRACT

A female member (1) of a snap fastener includes a main body (2) made of a metal and having a cylindrical tube portion (23) and a dish-shaped portion (22), a resin spring (3) housed in the main body (2), and a surface covering member (4) crimped onto the cylindrical tube portion (23). The resin spring (3) is a resin plate that can be housed in the main body (2), and the resin plate has a slot (35, 35A, 35B, 35C) at a central portion thereof. The cylindrical tube portion (23) has a support portion for the resin spring (3), and the resin spring (3, 3A, 3B, 3C) is fixed in position by the support portion.

1 Claim, 7 Drawing Sheets

(56) References Cited

U.S. PATENT DOCUMENTS

| | | | | |
|---|---|---|---|---|
| 4,441,234 | A * | 4/1984 | Kurashima | A44B 5/02 24/102 SL |
| 2010/0283269 | A1* | 11/2010 | Fiedler | A44B 11/258 292/251.5 |
| 2011/0041295 | A1* | 2/2011 | Reiter | A44B 17/0011 24/303 |
| 2018/0184766 | A1* | 7/2018 | Azab | A41F 1/00 |

FOREIGN PATENT DOCUMENTS

| | | | |
|---|---|---|---|
| JP | 2000-279209 | A | 10/2000 |
| JP | 3192241 | U | 8/2014 |
| WO | WO97/15207 | P | 5/1997 |

* cited by examiner

PRIOR ART 1

PRIOR ART 2

FEMALE MEMBER OF SNAP FASTENER AND RESIN SPRING USED THEREIN

TECHNICAL FIELD

The present invention relates to a female member of a snap fastener and a resin spring for use in the female member.

BACKGROUND ART

A female member of a snap fastener has an internal spring, and the female member and a male member are connected to each other by the spring resiliently supporting a head portion of the male member.

With regard to the material of the spring, a spring may be made of metal or resin. A spring made of metal makes squeaky sounds peculiar to metal, is trouble-prone, and is likely to corrode in washing and the like. On the other hand, a spring made of resin is free from these drawbacks. Moreover, a spring made of resin is well compatible with a metal main body, enables a weight reduction, is easy to attach even to a thin fabric, and has other advantages. Therefore, resin springs have recently been becoming widely used.

With regard to the shape of resin springs, most of the resin springs are ring-shaped or polygonal ring-shaped. Although many springs made of metal have a shape in which two wire rods oppose each other (hereinafter also abbreviated to a "double-spring" type), no resin springs of a double-spring type are known. The reason for this is that it is difficult to attach the opposing two spring elements of a resin spring in accurate alignment with each other or to fix the opposing two spring elements of a resin spring in such a manner as to prevent detachment from a main body of the female member.

Typical examples of a snap fastener having a resin spring are disclosed in WO 97/15207 and JP 2000-279209A. Both of the resin springs disclosed in these documents are a ring-shaped or polygonal ring-shaped resin spring.

PRIOR ART DOCUMENTS

Patent Documents

Patent Document 1: WO 97/15207
Patent Document 2: JP 2000-279209A

DISCLOSURE OF INVENTION

Problem to be Solved by the Invention

The resin spring disclosed in WO 97/15207 is formed separately from a main body of a female member. Although the detachment of the resin spring is prevented by an outer rim of the main body, there is a clearance, which allows the resin spring to move and thereby produce noise. Therefore, this resin spring is unsuitable for use in some fields.

Also, it is often desired to inscribe a letter or a figure on a metal leading end portion of the outer rim so as to add a high-quality appearance and a brand value, but it is difficult to achieve these purposes with this conventional technology. The reason for this is that, since, as shown in FIG. 8, an outer rim leading end portion 21X is crimped after a resin spring 3X is inserted from a front side (the side of engagement with a male member), not only the inscription is difficult in terms of space, but also the inscribing operation may damage the spring.

The resin spring disclosed in JP 2000-279209A is integrated with a main body of a female member. Therefore, the resin spring does not move. However, since a resin is coated with a metal, the processing is difficult, resulting in an increase in the molding cost. Also, a metal cap 22Y needs to be directly and firmly coupled to a main body 2Y of the female member, and the resin material used is thus limited to a hard resin material. Therefore, the resin spring is likely to lack resilience in joining to a male member. Consequently, the design flexibility of the spring is significantly reduced.

There is no problem regarding the inscription on the cap 22Y of the outer rim because, as shown in FIG. 9, the main body 2Y of the female member with which the resin spring 3Y is integrated is inserted into the cap 22Y from a back side (the side that is not brought into engagement with the male member), and then, a metal portion 21Y of an outer rim of the cap is crimped. The inscription on the cap can be performed in advance before the component is assembled.

In the present invention, a resin spring of a "double-spring" type, which has conventionally been regarded as impossible, is used. An object of the present invention is to provide a female member of a snap fastener, the female member having a structure in which a resin spring is separate from a main body of the female member, the resin spring being thus prevented from moving (and accordingly prevented from producing noise), and furthermore, the resin spring being able to be fixed so as not to detach from the main body of the female member.

Means for Solving Problem

A female member of a snap fastener according to an aspect of the invention is a female member of a snap fastener, the female member including a main body made of a metal and having a cylindrical tube portion and a dish-shaped portion, a resin spring housed in the main body, and a surface covering member crimped onto the cylindrical tube portion, wherein the cylindrical tube portion has a support portion for the resin spring, and the resin spring is fixed in position by the support portion (claim 1).

A female member of a snap fastener according to another aspect of the invention is a female member of a snap fastener, the female member including a main body made of a metal and having a cylindrical tube portion and a dish-shaped portion, a resin spring housed in the main body, and a surface covering member crimped onto the cylindrical tube portion, wherein the resin spring is a resin plate that can be housed in the main body of the female member, the resin plate having a slot at a central portion thereof, and the cylindrical tube portion has a support portion for the resin spring and the resin spring is fixed in position by the support portion (claim 2).

Preferably, the support portion for the resin spring, the support portion being provided in the cylindrical tube portion, is any of a slit, a stepped portion, and a small protrusion (claim 3).

A resin spring for use in a female member of a snap fastener is a resin plate that can be housed in a main body of the female member, the resin plate having a slot at a central portion thereof (claim 4).

Preferably, the resin spring is shaped like a handguard of a sword and is formed by two wide portions that oppose each other and two narrow portions that oppose each other (claim 5).

It is possible that walls of the wide portions that form the slot of the resin spring are inclined so that the area of the slot gradually increases in a fitting direction (claim 6).

Moreover, it is also possible that wire springs are used instead of the wide portions (claim 7).

Effects of the Invention

According to claim 1 or 2 of the present invention, the resin spring is fixed in position by the resin spring support portion of the cylindrical tube portion of the female member. Therefore, the resin spring is prevented from moving (and accordingly prevented from producing noise), and furthermore, the resin spring can be fixed so as not to detach from the main body of the female member.

There is no problem regarding the inscription on a metal portion of an outer rim, because the resin spring of the present invention is inserted from a back side (the side that is not brought into engagement with a male member), and the metal portion of the outer rim is crimped after the resin spring is fixed in position by the support portion. The inscription on the metal portion of the outer rim can be performed in advance before the component is assembled. In this regard, the present invention is similar to JP 2000-279209A.

However, in the present invention, unlike JP 2000-279209A, the resin spring and the metal portion of the outer rim are not firmly coupled to each other, and therefore the resin can be freely selected. That is to say, a variety of click sensations of the spring including a soft click sensation to a hard click sensation can be selected, a resin with excellent chemical resistance against a specific chemical can be adopted, and there are other various possibilities.

Furthermore, according to claim 2 of the present invention, the resin spring of a "double-spring" type is used, and thus, it is easy to secure an area on which a letter or a figure can be inscribed, and the fashionability can be improved.

According to claim 3 of the present invention, a resin spring of a "double-spring" type, which is a resin spring with a shape that can be more easily fixed in position by a support portion, can be obtained.

Hereinafter, embodiments of the present invention will be described based on the accompanying drawings.

BRIEF DESCRIPTION OF DRAWINGS

FIG. 2(*a*) is a plan view, FIG. 2(*b*) is a bottom view, FIG. 2(*c*) is a side view, FIG. 2(*d*) is a cross-sectional view taken along line D-D in FIG. 2(*a*), and FIG. 2(*e*) is a cross-sectional view taken along line E-E in FIG. 2(*a*).

FIG. 3(*a*) shows the cross section taken along line D-D in FIG. 2(*a*), and FIG. 3(*b*) shows the cross section taken along line E-E in FIG. 2(*a*).

MODES FOR CARRYING OUT THE INVENTION

Embodiment 1

Figure 1:
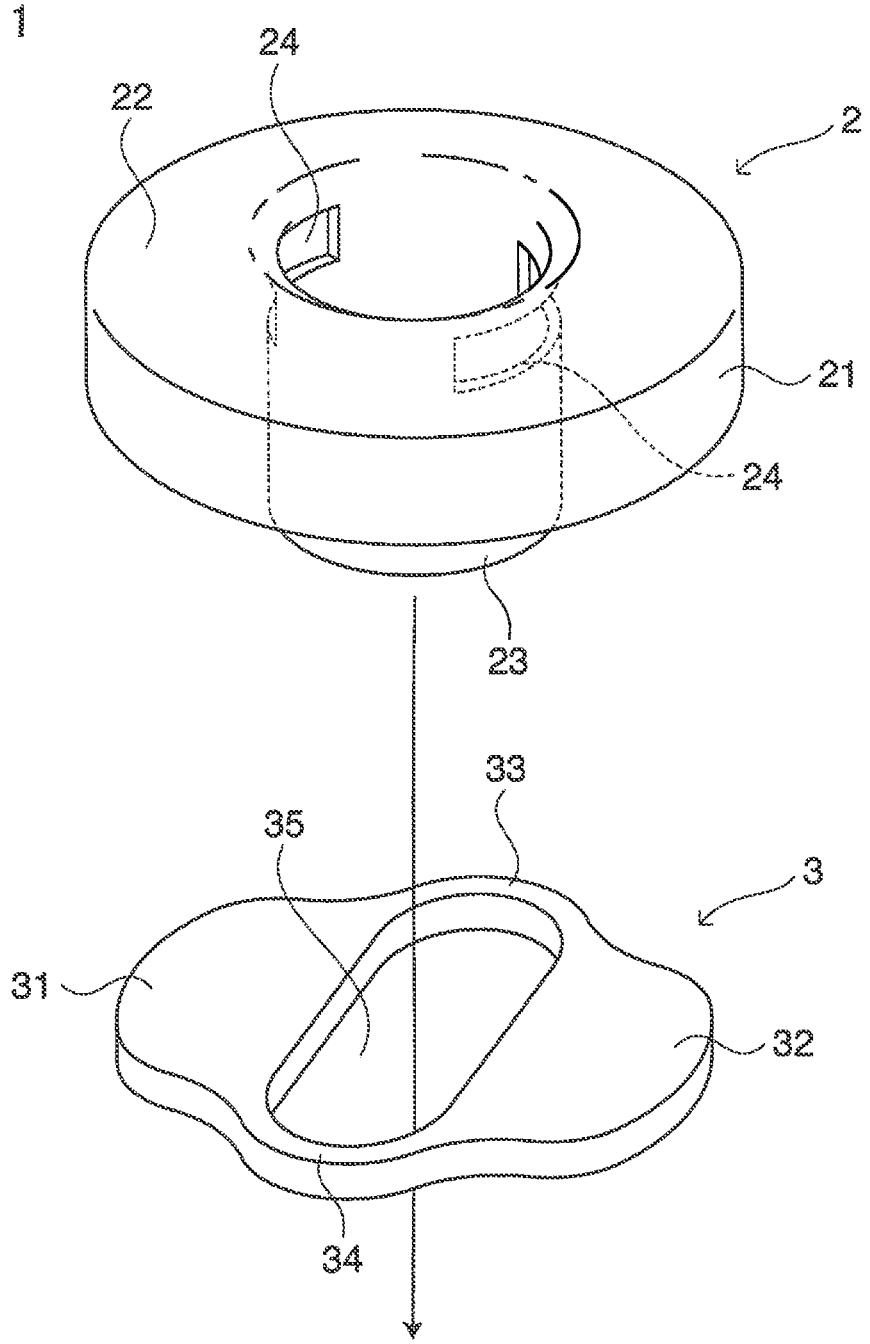
FIG. 1 is a perspective view showing a main body and a resin spring of a female member of a snap fastener according to an embodiment of the present invention.
Figure 2:
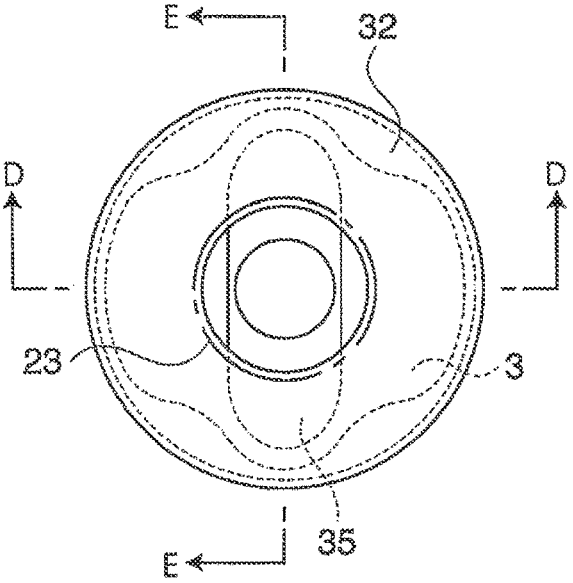
FIGS. 2(*a*) to 2(*d*) show the main body and the resin spring.
Figure 2:
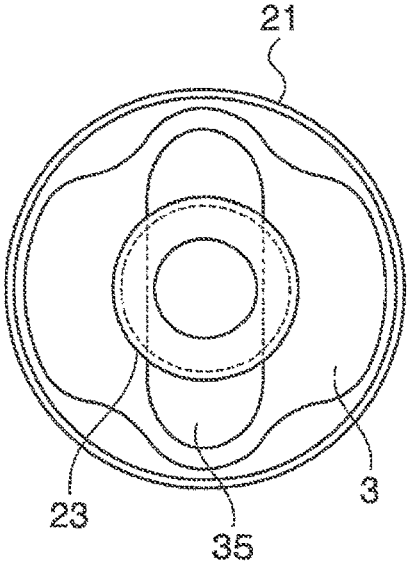
Figure 2:
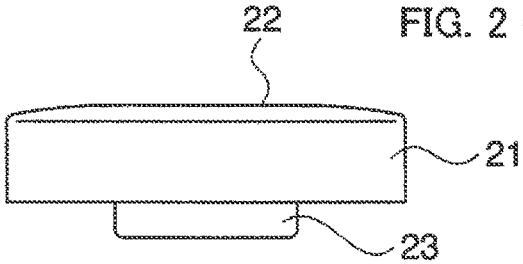
Figure 2:
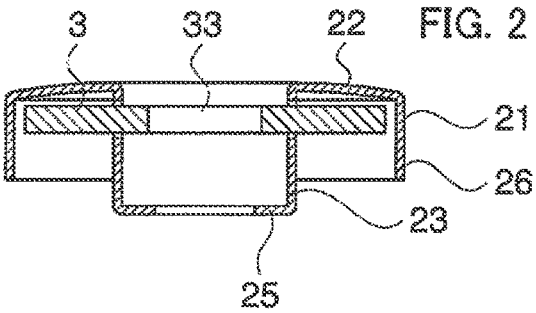
Figure 2:
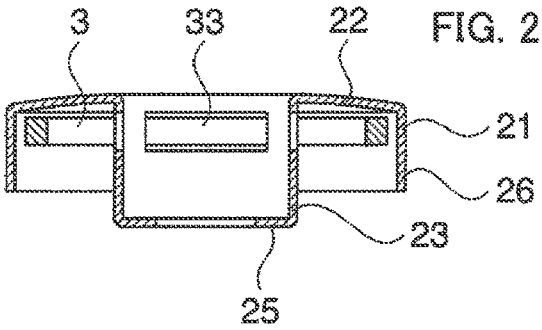

FIGS. 1 and 2 show a main body 2 and a resin spring 3 that are components constituting a female member 1 of a snap fastener.

The main body 2 is made of a metal such as brass, and has a dish-shaped portion 22 having a rim portion 21 and a cylindrical tube portion 23 protruding from the center of the dish-shaped portion 22. It is preferable that the entire main body 2 is integrally formed through deep drawing. A letter or a figure (not shown) can be inscribed on a surface of the dish-shaped portion 22. The cylindrical tube portion 23 has two slits 24 that are placed near the base thereof and oppose each other, and a leading end of the cylindrical tube portion 23 is bent in an inward direction of the cylindrical tube to form an inward flange 25.

The resin spring 3 is shaped like a handguard of a Japanese sword, and has a slot 35 that is formed by left and right wide portions 31 and 32 as well as upper and lower narrow portions 33 and 34 and extends in the vertical direction. This shape is similar to a metal spring ("double-spring" type) that has been introduced at the beginning of the specification and that has a shape in which two wire rods oppose each other. Polyamide (nylon) or polyester is preferable as the resin of the resin spring 3.

In this embodiment, the resin spring 3 has a length of 11.2 mm in the left-right direction and a length of 11.2 mm in the upper-lower direction, and the slot 35 has a width of 3.6 mm, a length of 9.6 mm in the longitudinal direction, and a thickness of 0.7 mm.

Figure 3:
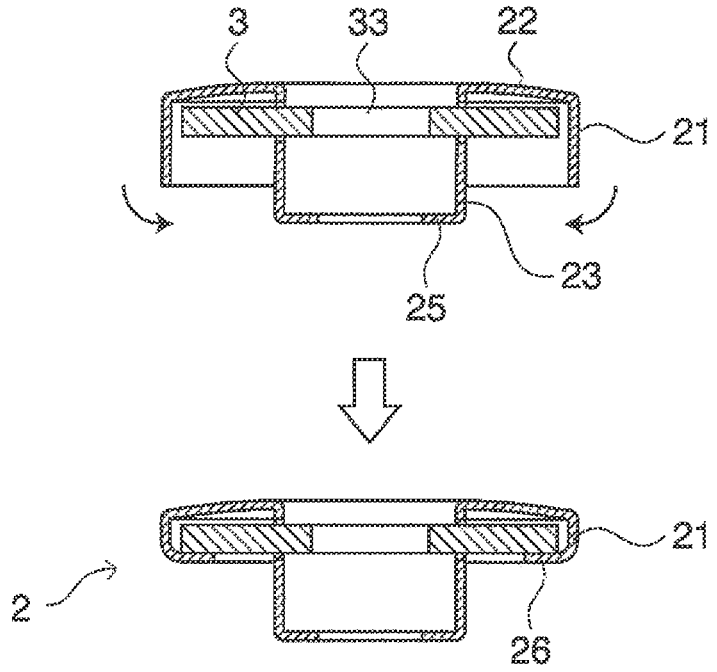
FIGS. 3(*a*) and 3(*b*) are cross-sectional views illustrating a process of fixing the resin spring through crimping.
Figure 3:
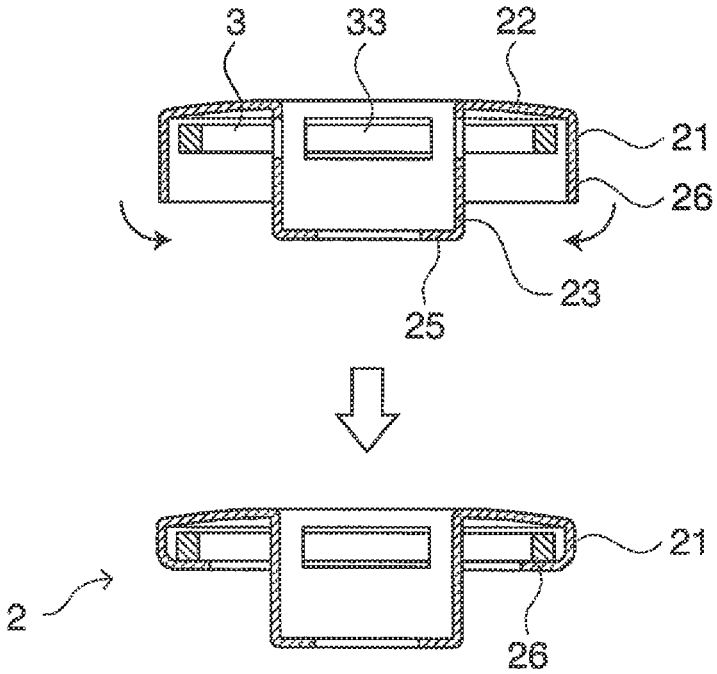

When this resin spring 3 is fitted to the main body 2, as shown in FIGS. 2(*a*) to 2(*e*), the resin spring 3 stops at the slits 24 of the cylindrical tube portion 23 and is fixed in this position. Furthermore, as shown in FIG. 3, a leading end 26 of the rim portion 21 of the main body 2 is crimped onto the resin spring 3. Although a slight gap is left between the resin spring 3 and the rim portion 21 of the main body 2, the resin spring 3 is supported and fixed by the slits 24 and the leading end 26 of the rim portion 21, and is therefore not allowed to move and unlikely to detach.

Figure 4:
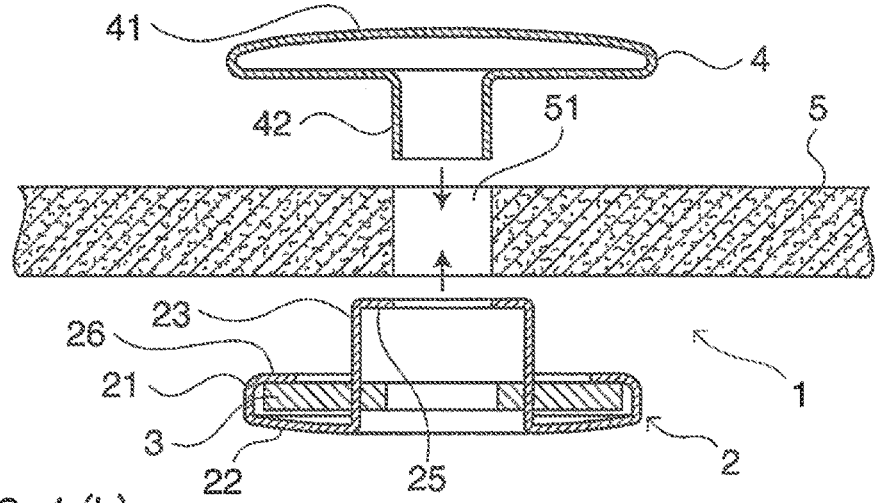
FIGS. 4(*a*), 4(*b*), and 4(*c*) are cross-sectional views illustrating a method for producing the female member of the snap fastener, and FIGS. 4(*c*) and 4(*d*) are cross-sectional views illustrating a method for fitting the female member and a male member to each other.
Figure 4:
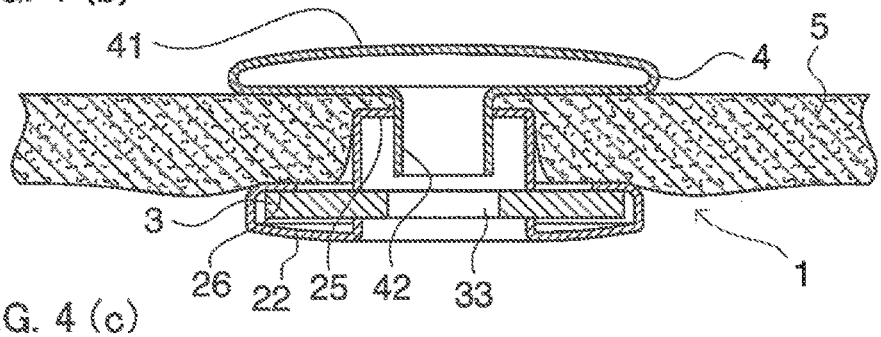
Figure 4:
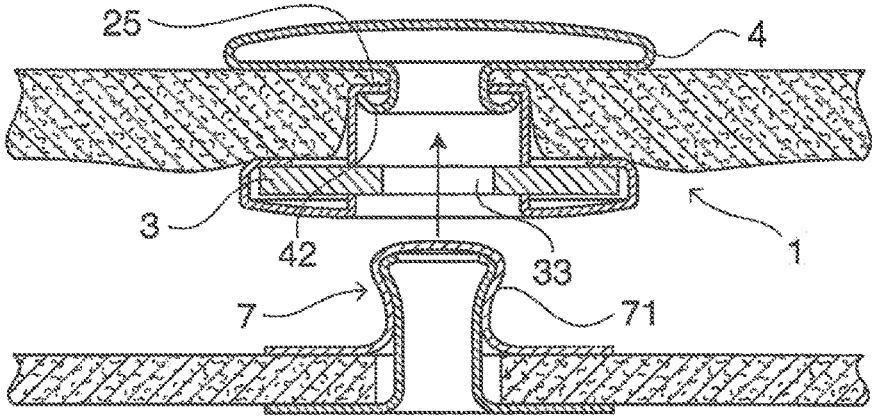
Figure 4:
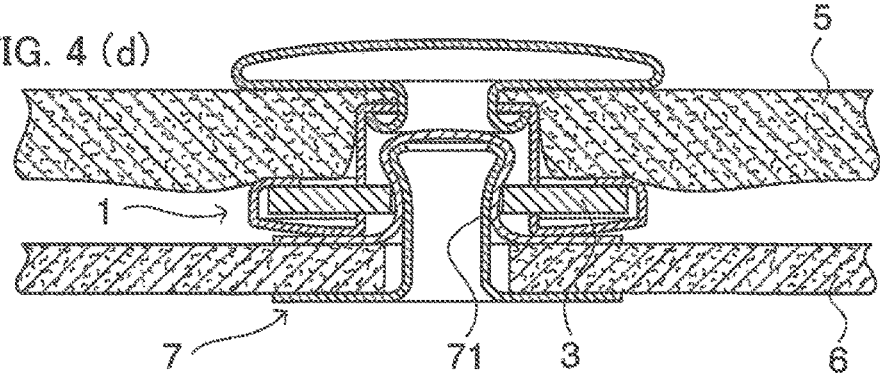

FIGS. 4(*a*) to 4(*c*) illustrates a manner in which the female member 1 of a snap fastener is formed using these components.

First, a surface covering member 4 is prepared separately from the female member components 2 and 3 in FIG. 1. The surface covering member 4 has a disk-shaped decorative plate 41 and a cylindrical leg portion 42 extending downward from the center thereof. It is preferable that the decorative plate 41 and the leg portion 42 are integrally formed using a metal such as brass.

As shown in FIGS. 4(*a*) and 4(*b*), the female member components 2 and 3 in FIG. 1 and the surface covering member 4 are fitted together with a hole 51 that is preliminarily formed in a fabric 5 sandwiched therebetween. As shown in FIG. 4(*c*), the leg portion 42 of the surface covering member 4 is crimped onto the flange 25 of the cylindrical tube portion 23 using a crimping machine, and thus the female member 1 of a snap fastener is completed.

This female member 1 of the snap fastener can be snap-fitted to a male member 7 of the snap fastener that is fixed to a fabric 6. In the fitted state, as shown in FIG. 4(*d*), the resin spring 3 of the female member 1 of the snap fastener presses against and resiliently supports a head portion 71 of the male member 7.

Figure 5:
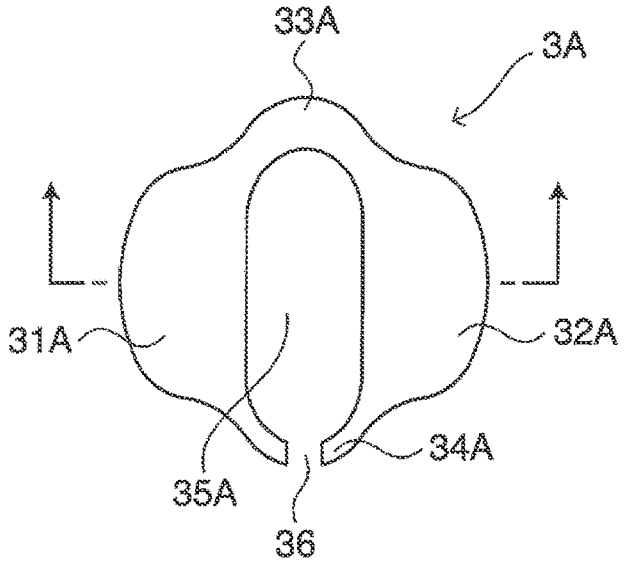
FIGS. 5(*a*) and 5(*b*) are a front view and a horizontal cross-sectional view, respectively, showing a modification (Embodiment 2) of the resin spring.
Figure 5:
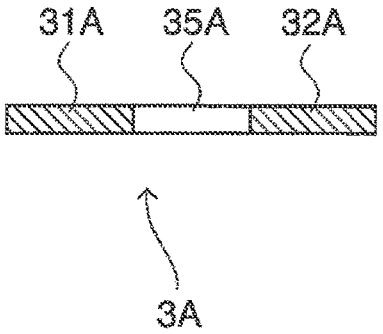
Figure 6:
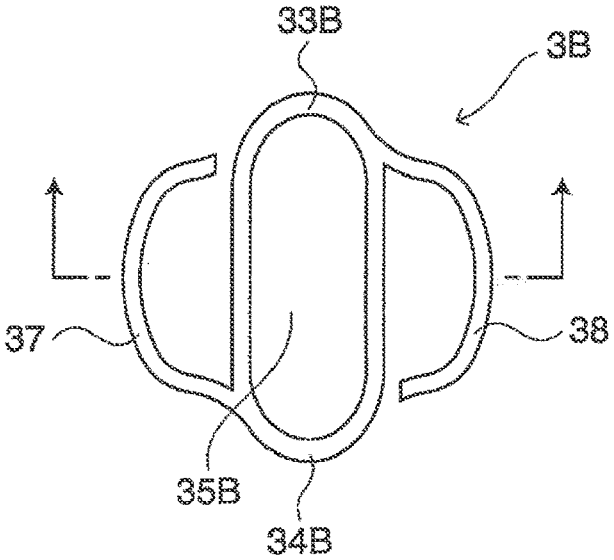
FIGS. 6(*a*) and 6(*b*) are a front view and a horizontal cross-sectional view, respectively, showing a modification (Embodiment 3) of the resin spring.
Figure 6:
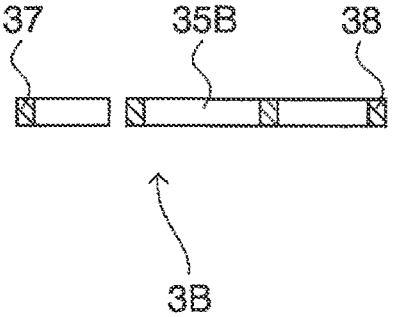
Figure 7:
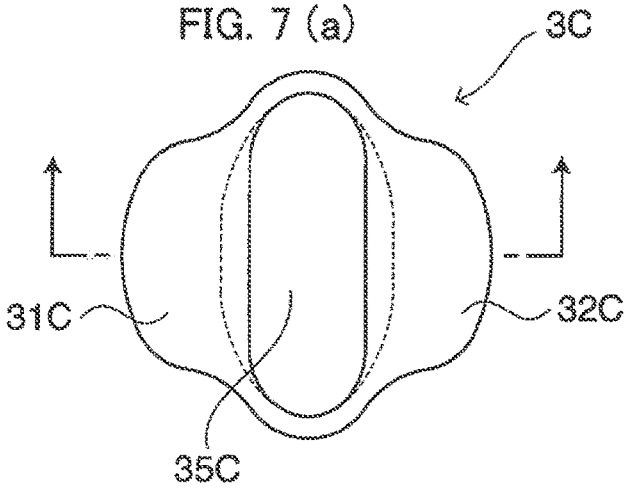
FIGS. 7(*a*) and 7(*b*) are a front view and a horizontal cross-sectional view, respectively, showing a modification (Embodiment 4) of the resin spring.
Figure 7:
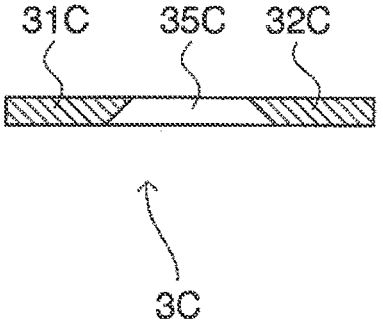
Figure 8:
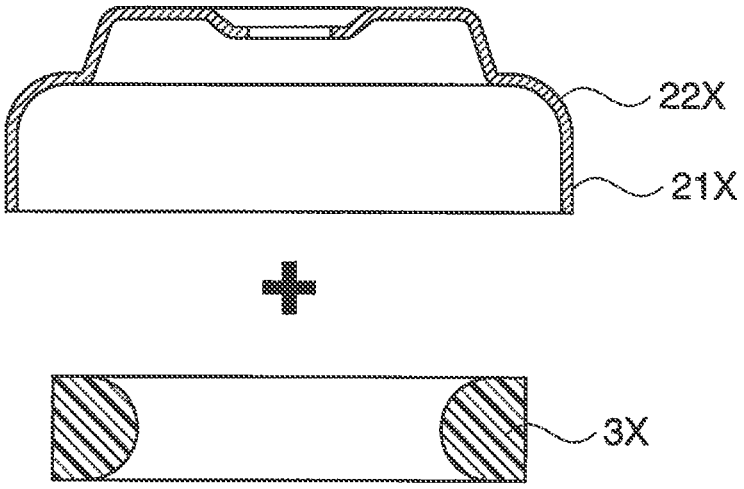
FIGS. 8(*a*) and 8(*b*) are cross-sectional views illustrating a production process according to a conventional technology 1 (WO 97/15207).
Figure 8:
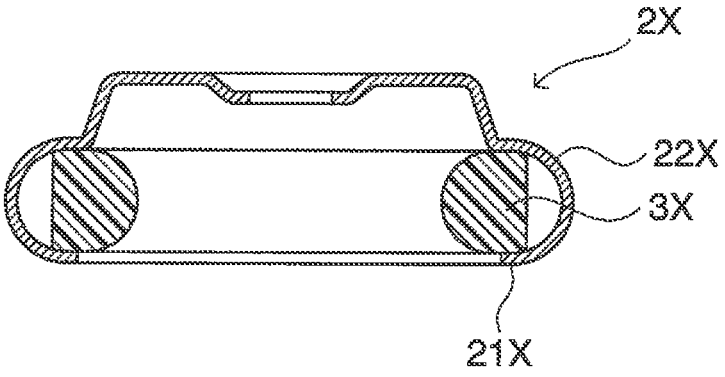
Figure 9:
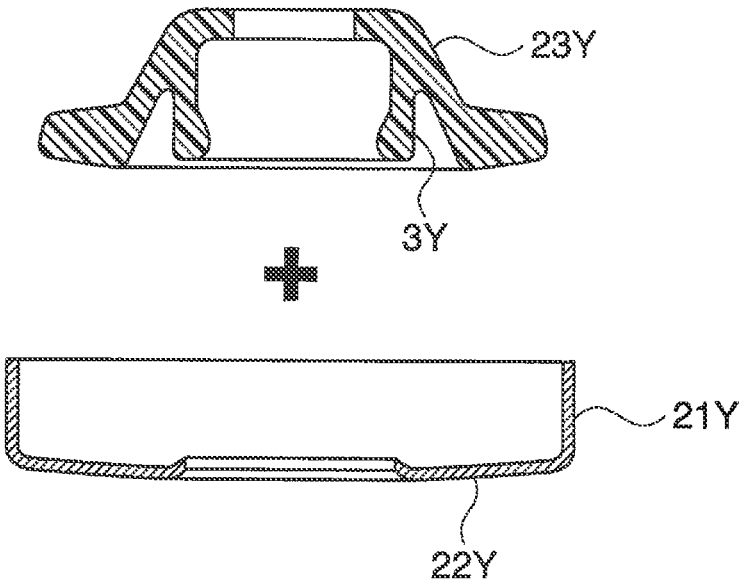
FIGS. 9(*a*) and 9(*b*) are cross-sectional views illustrating a production process according to a conventional technology 2 (JP 2000-279209A).
Figure 9:
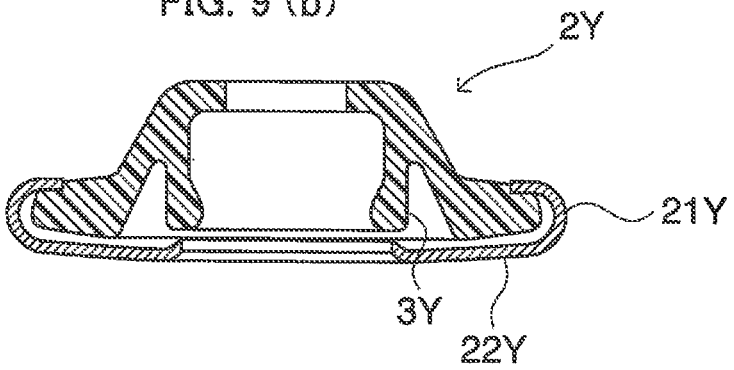

FIGS. 5 to 7 show modifications of the resin spring.

Embodiment 2

A resin spring 3A in FIG. 5 has a slit 36 in one narrow portion 34A Since the strength is reduced, it is preferable to increase the length in the upper-lower direction of a narrow portion 33A that opposes the narrow portion 34A.

Embodiment 3

A resin spring 3B in FIG. 6 has wire springs 37 and 38 instead of the wide portions 31A and 32A Each wire spring extends in a circular arc shape from near a corresponding one end portion of the slot in the longitudinal direction along the rim portion of the dish-shaped portion. With this configuration, a weight reduction can be achieved.

Embodiment 4

A resin spring 3C in FIG. 7 is similar to that of Embodiment 1, but has a configuration in which walls of wide portions 31C and 32C that form a slot 35C are inclined so that the area of the slot 35C gradually increases in a fitting direction. With this configuration, the head portion 71 of the male member 7 is easily received in the resin spring 3C, but it is difficult to pull out the head portion 71 therefrom.

REFERENCE SIGNS

1 Snap fastener female member
2 Main body
2X Main body (conventional technology)
2Y Main body (conventional technology)
21 Rim portion
22 Dish-shaped portion
22X Dish-shaped portion (conventional technology)
22Y Dish-shaped portion (conventional technology)
23 Cylindrical tube portion
24 Slit
25 Flange
26 Leading end of rim portion
3 Resin spring
3A Resin spring
3B Resin spring
3C Resin spring
3X Resin spring (conventional technology)
3Y Resin spring (conventional technology)
31, 32 Wide portion
31A, 32A Wide portion
31C, 32C Wide portion
33, 34 Narrow portion
33A Narrow portion
34A Narrow portion
35 Slot
35C Slot
36 Slit
37, 38 Wire spring
4 Surface covering member
41 Decorative plate
42 Leg portion
5, 6 Fabric
51 Hole
7 Snap fastener male member

The invention claimed is:

1. A female member (1) of a snap fastener, the female member (1) of a snap fastener comprising:

a main body (2) made of a metal and having a cylindrical tube portion (23) and a dish-shaped portion (22);

a resin spring (3) housed in the main body (2); and a surface covering member (4) crimped onto the main body (2), wherein the resin spring (3) is a resin plate that can be housed in the main body (2) of the female member, the resin plate having a slot (35, 35A, 35B, 35C) at a central portion thereof, and the cylindrical tube portion (23) has two slits (24) that oppose each other, and the resin spring (3, 3A, 3B, 3C) is fixed in position by the two opposing slits (24).

* * * * *